US008240933B2

(12) United States Patent
Skalitzky et al.

(10) Patent No.: US 8,240,933 B2
(45) Date of Patent: Aug. 14, 2012

(54) HEATED FLOWABLE PRODUCT DISPENSER

(75) Inventors: Michael J. Skalitzky, Kenosha, WI (US); Stephen B. Leonard, Franksville, WI (US); Jeffrey L. Harwig, Franklin, WI (US); Steven C. Shirley, Racine, WI (US); Richard L. Norwood, Racine, WI (US); Fuk Yuen Cheng, Hong Kong (CN); Zhi Bin Wen, Hunan (CN); Jian Shi, Jiangshu (CN); Robert J. Kopanic, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/228,796

(22) Filed: Sep. 9, 2011

(65) Prior Publication Data

US 2012/0003025 A1 Jan. 5, 2012

Related U.S. Application Data

(62) Division of application No. 11/734,368, filed on Apr. 12, 2007, now Pat. No. 8,061,918.

(60) Provisional application No. 60/791,864, filed on Apr. 13, 2006.

(51) Int. Cl.
*B67D 3/00* (2006.01)

(52) U.S. Cl. ..... 401/188 R; 401/1; 222/146.5; 222/325; 222/372

(58) Field of Classification Search ..... 401/188 R, 401/1, 2; 222/146.5, 325, 372, 146.2, 377, 222/380; 141/82, 363, 365, 366; 392/473, 392/476, 477

See application file for complete search history.

(56) References Cited

U.S. PATENT DOCUMENTS

| | | | | |
|---|---|---|---|---|
| 1,214,600 | A | 2/1917 | Silverthorne | |
| 2,056,096 | A | 9/1936 | Etter | |
| 2,551,676 | A | 5/1951 | Hoffman | |
| 2,784,882 | A | 3/1957 | Du Bois | |
| 3,116,403 | A | 12/1963 | Carter | |
| 3,303,971 | A | 2/1967 | Stevens | |
| 3,346,908 | A | 10/1967 | Johnson | |
| 3,581,940 | A | 6/1971 | Cella | |
| 3,823,851 | A * | 7/1974 | Waters | 222/146.3 |
| 3,826,409 | A | 7/1974 | Chilcoate | |
| 3,843,022 | A | 10/1974 | Radcliffe et al. | |

(Continued)

FOREIGN PATENT DOCUMENTS

| | | |
|---|---|---|
| CA | 2118388 | 1/1999 |

(Continued)

OTHER PUBLICATIONS

A PCT search report in a corresponding application PCT/US2007/009071, dated Dec. 17, 2007.

*Primary Examiner* — David Walczak

(57) ABSTRACT

A bottle includes a product stored therein. It is configured to be removably engaged with a docking station in an inverted arrangement to be activated by the docking station and heat the product. The bottle may include a pump structure (e.g. in the form of a bellows), or be a squeezable bottle, or be a bowable bottle, or have other pumping features. Structures are provided to prevent drool after use, to help apply the heated product to the skin, and to insure proper heating and dispensing. There are combined docking stations and bottles where the bottle is positioned in an inverted manner, and methods for using these devices.

9 Claims, 13 Drawing Sheets

U.S. PATENT DOCUMENTS

| | | | | |
|---|---|---|---|---|
| 3,917,121 | A | | 11/1975 | Ciaffone |
| 3,997,083 | A | * | 12/1976 | McNair ..... 222/146.3 |
| 4,286,636 | A | | 9/1981 | Credle |
| 4,421,973 | A | * | 12/1983 | Lou ..... 392/477 |
| 4,516,697 | A | | 5/1985 | Dreps et al. |
| 4,517,445 | A | | 5/1985 | Tatsumi |
| 4,614,859 | A | | 9/1986 | Beckering |
| 4,693,270 | A | | 9/1987 | Yaindl |
| 4,813,556 | A | | 3/1989 | Lawrence |
| 5,065,912 | A | | 11/1991 | Rosenthal |
| 5,142,610 | A | | 8/1992 | Augustine |
| 5,390,692 | A | | 2/1995 | Jones et al. |
| 5,622,284 | A | | 4/1997 | Sawicki |
| 5,669,520 | A | | 9/1997 | Simpson |
| 5,699,921 | A | | 12/1997 | Rodriguez |
| 5,709,318 | A | | 1/1998 | Oder |
| D405,531 | S | | 2/1999 | Bonds |
| 6,016,939 | A | | 1/2000 | Gueret |
| 6,083,450 | A | | 7/2000 | Safian |
| 6,116,475 | A | | 9/2000 | Delage |
| 6,206,951 | B1 | | 3/2001 | Fugleberg |
| 6,216,911 | B1 | | 4/2001 | Kreitemier et al. |
| 6,238,201 | B1 | | 5/2001 | Safian |
| 6,311,868 | B1 | | 11/2001 | Krietemeier et al. |
| 6,394,315 | B1 | | 5/2002 | Banks |
| 6,454,127 | B1 | | 9/2002 | Suomelia et al. |
| 6,601,720 | B2 | | 8/2003 | Meyers et al. |
| 6,719,173 | B2 | | 4/2004 | Safian |
| 7,000,806 | B2 | | 2/2006 | Py |
| 7,640,766 | B2 | | 1/2010 | Shelton |
| 2002/0074355 | A1 | | 6/2002 | Lewis |
| 2004/0124988 | A1 | | 7/2004 | Leonard et al. |

FOREIGN PATENT DOCUMENTS

| | | |
|---|---|---|
| EP | 333093 | 9/1989 |
| EP | 905051 | 3/1999 |
| EP | 649795 | 6/1999 |
| EP | 1500602 | 1/2005 |
| GB | 1316592 | 5/1973 |
| WO | WO 98/14387 | 4/1998 |
| WO | WO 2004/022436 | 3/2004 |
| WO | WO 2005/002283 | 1/2005 |

* cited by examiner

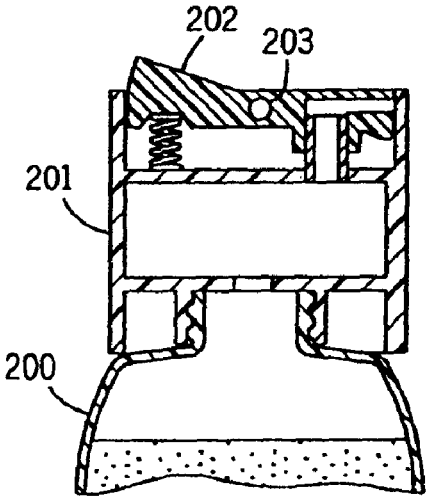
FIG. 23
FIG. 24
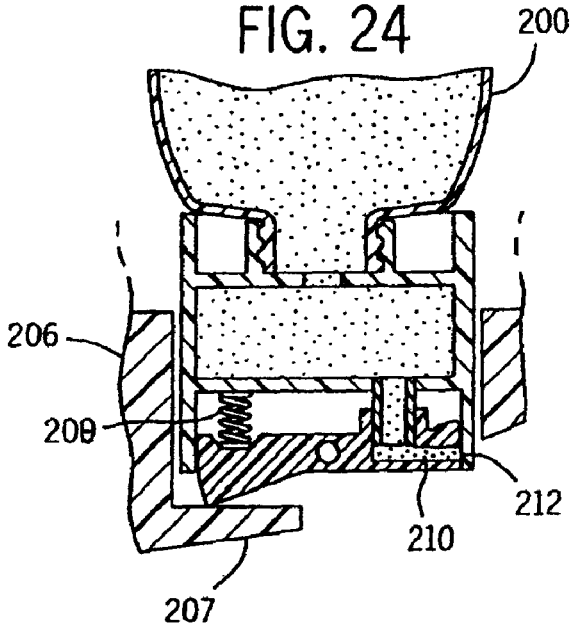
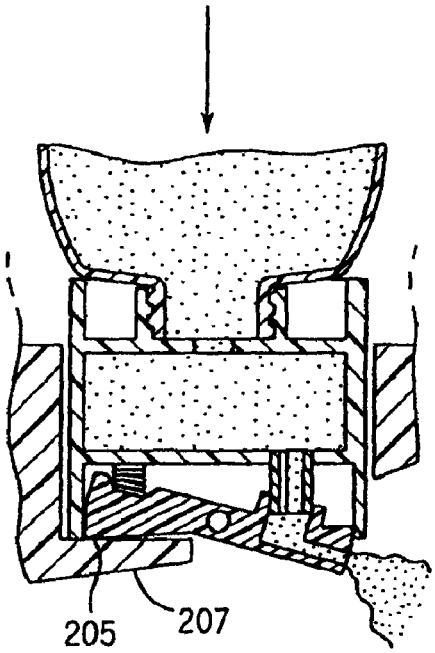
FIG. 25
FIG. 26
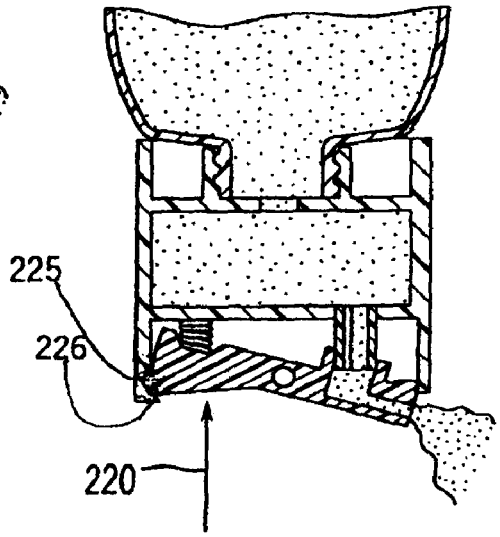

HEATED FLOWABLE PRODUCT DISPENSER

CROSS-REFERENCE TO RELATED APPLICATIONS

Priority is claimed based on U.S. provisional application 60/791,864 filed on Apr. 13, 2006, and U.S. Ser. No. 11/734,368 filed Apr. 12, 2007 (now issued as U.S. Pat. No. 8,061,918).

STATEMENT REGARDING FEDERALLY SPONSORED RESEARCH/DEVELOPMENT

Not applicable.

BACKGROUND OF THE INVENTION

The present invention relates to devices for dispensing heated flowable products such as personal care products (e.g. heated shaving lotions and skin lotions), home cleaning products, or any other type of product that is desired to be heated and which can withstand an elevated temperature above an ambient temperature. More specifically it relates to such devices that have portable containers that can be energized by a base unit to heat products, as well as to structures that permit heated products to be dispensed from the container adjacent the base or alternatively remote there from.

Certain personal care products, cleaners and other compositions are advantageously used in a heated condition. For example, many prefer to shave using heated shave cream to help soften the beard as well as provide desirable skin feel. Similarly, some skin lotions (e.g. particularly massaging lotions) are preferably delivered when heated.

To this end barbers and other personal care workers have been known to maintain large containers of shaving creams and the like that are consistently heated so as to be readily available for application to customers throughout the day. Some similar systems have been developed for home use. However, continuous heating of a main reservoir of cream or lotion risks degradation of the cream or lotion over time, and in any event uses unnecessary amounts of energy.

A variety of devices have been developed in which the cream or lotion is stored in a main container and only the portion about to be used is heated in an adaptor or other heater system adjacent an outlet. Many of these systems use an electrical cord to link an adaptor mounted on an aerosol or other container to a power supply. While such systems do have some utility, they limit the consumer's ability to use the dispenser at a location remote from the power supply. For example, women may prefer to shave their legs in the shower and it is impractical to use such cord linked systems within a shower environment.

U.S. Pat. No. 6,454,127 disclosed a container which contained a liquid to be dispensed. An adaptor was positioned at the top of the container with a pump. The adaptor was powered by a separate base. With this system the heated liquid being dispensed could be dispensed adjacent a power base (e.g. at a counter top), or the container can be removed from the base and taken to a remote location where, for some period of time, enough heat remained in the adaptor so that heated liquid could be dispensed from the container remote from the base. However, this system relied on an awkward pumping mechanism, and has certain other deficiencies.

Another concern with some prior art systems, particularly those relying on pumping or pressurized containers, is that even after a consumer has stopped activating the dispensing apparatus, because of residual pressure in the outlet area, and/or the expandable/foaming nature of the cream or lotion being delivered, the nozzle will have a tendency to "drool" during the next hour or so, leaving a somewhat unsightly appearance. The drooled material will be exposed to air and therefore also degrade.

Still other systems are designed for delivering heated lotions, creams or other materials where the system has undesirably small capacity (e.g. certain aerosol systems), or is difficult to refill or provide replacement supply for.

In still other such devices the device requires extended warm-up time to cause a desired amount of cream or lotion to be heated to the desired temperature, or is designed in a way that if more than a relatively small amount of lotion or cream is dispensed within a short time period the device will begin to deliver insufficiently heated product.

In still other such devices the means of causing the delivery of the heated product when at a base station is awkward and/or inefficient and/or non-intuitive.

It is also of concern that these devices typically require the use of a human hand to work the cream or lotion into or against the skin. Consumers may prefer not to use this manner of applying the cream or lotion, and/or for some purposes this manner of applying the product may not be optimal.

It can therefore be seen that improvements are desired with respect to product dispensers that dispense heated creams, lotions or the like, particularly with respect to the above deficiencies and ways to minimize problems caused by the above deficiencies.

BRIEF SUMMARY OF THE INVENTION

In one aspect the invention provides a bottle having a flowable product stored therein and configured to be removably engaged with a docking station so as to be activated by the docking station and heat a portion of the flowable product. The bottle has a housing having an internal main reservoir storing the flowable product.

In one form there is a pump in the form of a compressible bellows linked to the housing in a manner suitable to pump flowable product from the housing when the bottle is inverted. There is also a heating element positioned proximate to the pump which is capable of heating a portion of the flowable product once it is pumped from the reservoir.

The heating element is activatable by the docking station. Also, there is an outlet arranged downstream of the heating element which is suitable to receive heated flowable product.

In this form, the heating element is positioned proximate to a baffled pathway that connects the pump with the outlet, and there is at least one check valve associated with the bellows to control movement of the flowable product past the pump. The check valve can be upstream of the bellows inhibiting flow from the bellows back to the main reservoir, or be downstream of the bellows to inhibit flow back to the bellows from a position downstream of the bellows. In the latter case the check valve may have a bleed passage.

In an alternative form the invention provides a bottle having a flowable product stored therein and configured to be removably engaged with a docking station so as to be activated by the docking station and heat a portion of the flowable product. In this case the bottle has a housing with a flexible side, the housing having an internal main reservoir storing the flowable product.

There is a heating element which is capable of heating a portion of the flowable product once it is driven from the reservoir, the heating element being configured to be activatable by the docking station. There is also an outlet arranged downstream of the heating element and suitable to receive heated flowable product. Upon squeezing the flexible side of the housing the flowable product can be driven out the outlet.

A particularly desirable form is where the flexible side has a bellows configuration which permits the housing to be axially compressed, as well as squeezed along its side.

If desired the bottle may also have a cap downstream of the heating element through which the outlet extends, and the cap may have a surface suitable to contact human skin. For example, the cap may be capable of being heated by the heating element; and/or be textured on its outer surface for working the flowable product against human skin.

The cap may have raised bumps and fine abrasive surfaces capable of contacting human skin. The cap may also have a brush and/or a sponge surface.

In yet another even more preferred aspect of the invention there is provided a bottle having a flowable product stored therein and configured to be removably engaged with a docking station so as to be activated by the docking station and heat a portion of the flowable product. This bottle has a housing, the housing having an internal cavity, a collapsible bag positioned in the cavity for storing the flowable product, a heating element which is capable of heating a portion of the flowable product once it is driven from the bag, the heating element being configured to be activatable by the docking station, and an outlet arranged downstream of the heating element and suitable to receive heated flowable product.

In still another aspect the invention provides a bottle having a flowable product stored therein and configured to be removably engaged with a docking station so as to be activated by the docking station and heat a portion of the flowable product. This alternative bottle has a housing having an internal main reservoir storing the flowable product, a heating element positioned proximate to the housing which is capable of heating a portion of the flowable product once it is driven from the reservoir, the heating element being configured to be activatable by the docking station, and an outlet arranged downstream of the heating element and suitable to receive heated flowable product. A side of the housing contains a bellows structure such that the housing can bow in a direction and thereby drive flowable product from the main reservoir out the outlet.

Further aspects of the invention relate to there being provided a bottle where there is a flap is positioned adjacent the outlet to inhibit drool of the flowable product after active pumping has ceased. This can be used with a check valve having a bleed path positioned downstream of the pump and upstream of the flap to further inhibit drool of the flowable product after active pumping has ceased, or the flap can be positioned on a disk where the flap is formed by a slit structure in the form of a cross.

Alternatively, to minimize drool between uses the device can be provided with a spring loaded flip cap structure. When the bottle is installed at the docking station, but not pressed down, the spring biases the flip cap closed. When the bottle is pressed down against a ledge of the docking station the spring pressure is overcome and the flip cap opens. When the bottle is used apart from the docking station one can hold the flip cap down manually while squeezing the bottle sides, and may even lock the cap into an open position.

Another form of the invention relates to a device for dispensing a heated flowable product. There is a docking station connectible to an electrical power source, a bottle having a flowable product stored therein, the bottle having a heater and means for driving the heated flowable product out of the bottle, and the bottle is removably engaged with the docking station with the bottle being inverted so that while its heater is positioned adjacent a downward end of the device the bottle can be activated by the docking base so that the bottle can heat a portion of the flowable product, and heated flowable product can be dispensed while the bottle is inverted and engaged with the docking station.

Alternatively, the invention can relate to methods of using such bottles and devices where a bottle is positioned in an inverted fashion in a docking station and the flowable product is caused to be heated while the bottle is docked at the docking station. One then removes the bottle from the docking station to a remote site (e.g. a shower). One then dispenses still heated flowable product from the bottle at the remote site by causing the pump to eject heated flowable product from the bottle.

It will be appreciated from the above and the following description and the drawings that the present invention has a number of advantages. In addition to providing a heated lotion/cream dispenser that can be used at a counter top or alternatively at a remote site, the device is configured so that gravity facilitates dispensing at the base. Thus, less energy is needed to dispense the heated product, and there is less tendency for difficulty in dispensing the last remaining product in the container.

Further, the heating adaptor unit can be separately formed and used with multiple containers sequentially. Thus, after using up the product in one container, the heater can be re-used. Alternatively, the heating adaptor unit can be linked to the canister, making the combined item a throw-away unit.

Additionally, the device reliably heats product without unnecessarily heating substantial product that is not likely to be quickly dispensed. Further, the device is relatively inexpensive to produce given the functions being provided.

The foregoing and other advantages of the present invention will be apparent from the following description. In that description reference is made to the accompanying drawings which form a part thereof; and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 23 is a schematic sectional view of a further dispensing device having a flip top cap;

FIG. 24 is a schematic sectional view showing that bottle inverted and resting in a docking station;

FIG. 25 is a view similar to FIG. 24, but showing the bottle pressed down to dispense lotion from the docking station;

FIG. 26 is a view similar to FIG. 25, but without the docking station, with a snap lock structure, and with a manual pressure being applied to the flip cap.

DETAILED DESCRIPTION OF THE INVENTION

Figure 1:
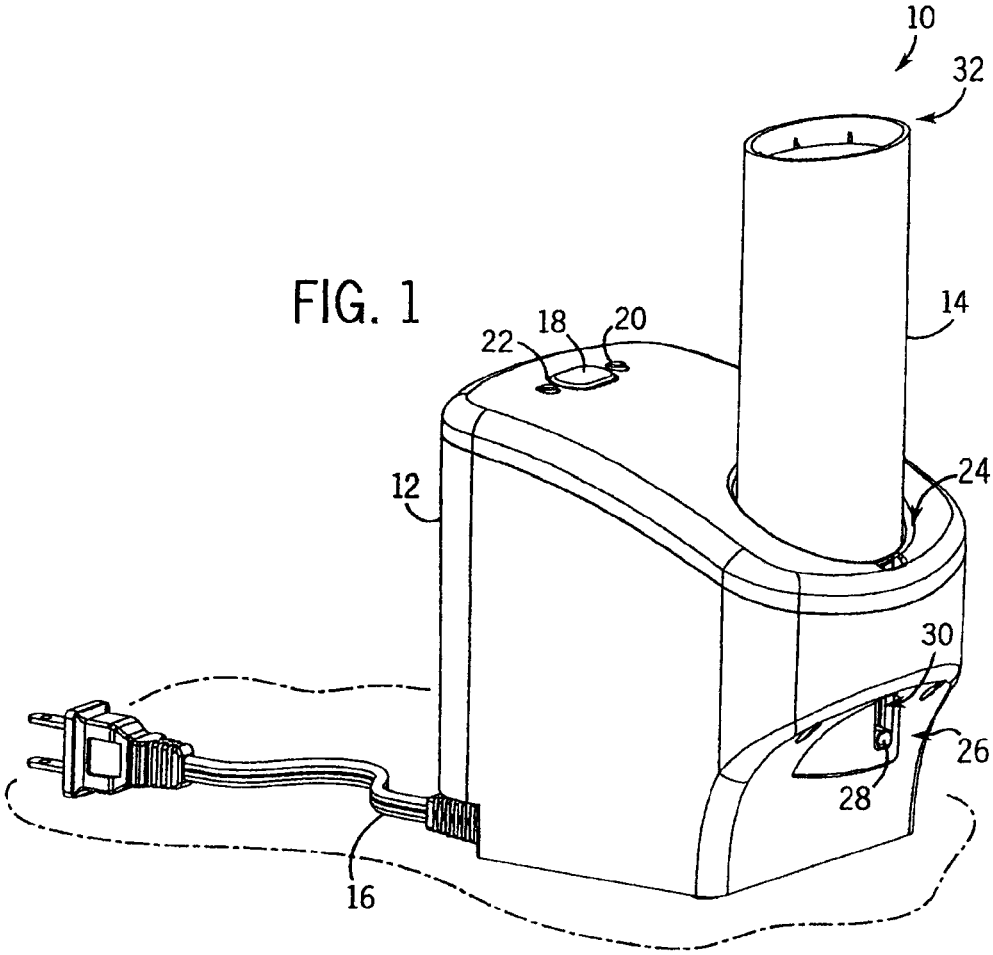
FIG. 1 is a perspective view of a dispensing bottle engaged with a docking station in accordance with the present invention.

Referring to FIG. 1, a product dispensing device 10 includes a docking station 12 that receives a dispensing bottle 14 in an inverted arrangement. The docking station 12 includes a power cord 16 adapted to be received by a utility power receptacle (not shown) to deliver power to the docking station 12. The docking station 12 transmits the power received from the power cord 16 to the bottle 14 that, in turn, heats a portion of the product as it is delivered from a reservoir cavity of the bottle 14.

To turn the supply of power delivered from the docking station 12 to the bottle 14 on or off, a power switch 18 is provided. Additionally, the docking station includes a pair of indicator lights 20, 22 that are designed to indicate whether the docking station is currently delivering power that is consumed by the bottle 14 to heat a portion of the product or whether the docking station 12 is in a standby mode where no power is being delivered from the docking station 12. There may be other indicator lights as well (e.g. to indicate when the product is sufficiently heated).

For example, one indicator light 20 may be a green light that when lit indicates to its user that the docking station is not currently delivering power, such as might occur when a desired quantity of the product has reached a desired temperature or when the bottle 14 has been removed from the docking station. In this same regard, the other indicator light 22 may be a red light that when lit indicates to the user that the docking station 12 is currently delivering power to the bottle 14 to heat a portion of the products.

While the heating system will be described below in the context of electricity from the docking station preferably powering a resistance heater in a device linked to the bottle, the docking station could instead alternatively provide a magnetic field that induces a magnetic heating system located on a device linked to the bottle. Alternatively, energy could be supplied in other forms which ultimately leads to heating at the bottle. Hence, by describing the docking station as activating the heater, we are referring to supplying electrical power, or alternatively supplying other sources of energy causing the heater to heat.

It is contemplated that the product stored in the bottle 14 may take any of a variety of forms, provided that it be of a type suitable to be heated (e.g. ranging from a few degrees to as much as 30 or more Centigrade degrees of heating). Where the product is to be delivered to a hand or directly to other human skin the heating will be correspondingly limited to avoid discomfort. Particularly preferred products for use with the present invention are liquids or gels used for various skin care purposes such as shaving, moisturizing, cleaning, or massaging. However, the device could alternatively deliver a heated hard surface cleaner or other heated formulation (e.g. therapeutics, food items such as syrup, melted cheese or hot fudge, etc.).

In accordance with one preferred embodiment, the device can be configured to dispense a skin care lotion of the type commonly dispensed from heated dispensers. Alternatively, the devices of the present invention can dispense a shaving cream or lotion, or other product, of the type suitable to be dispensed from a heated dispenser. For example, a skin care lotion could have 80 to 90 percent water, 2 to 10 percent petrolatum, and heat activated proteins in the range of 1 to 10 percent.

Figure 2:
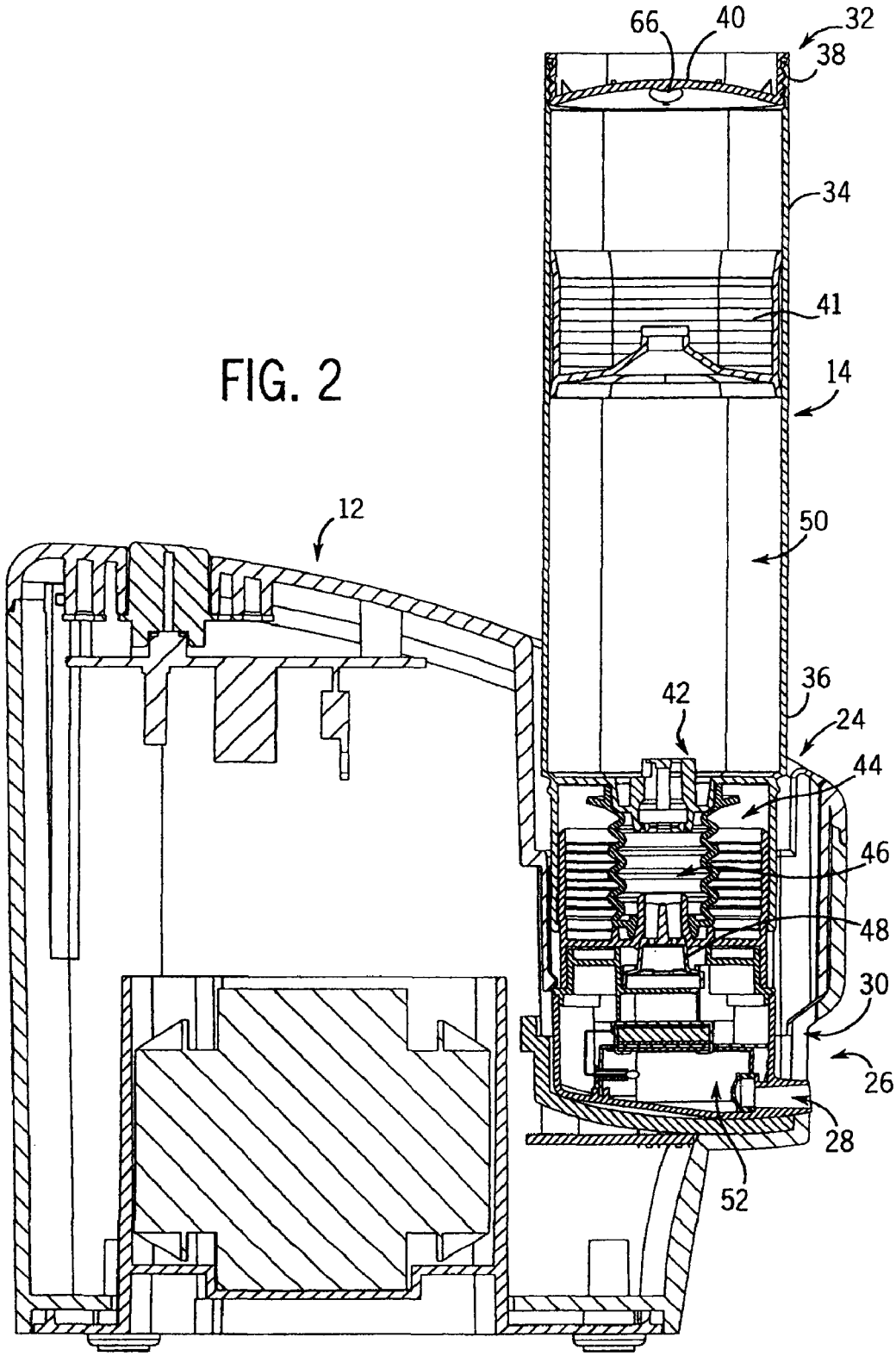
FIG. 2 is a vertical sectional view of the dispensing bottle and docking station of FIG. 1.

Referring next to FIG. 2, a vertical cross-sectional view of the dispensing bottle 14 and docking station 12 shows that the docking station 12 includes a receiving port 24 configured to receive the dispensing bottle 14 in an inverted fashion. That is, the docking station 12 is designed to receive the bottle such that a first end 26 of the dispensing bottle 14 having an outlet port 28 formed thereabout passes into the receiving port 24 of the docking station 12.

The docking station 12 includes a portal 30 through which the outlet port 28 of the dispensing bottle 14 extends to provide a user with access to the outlet port 28 through which a product disposed within the dispensing bottle 14 is ejected when the dispensing bottle is engaged with the docking station. In this regard, the outlet port 28 forms a spigot from which the product is delivered as the bottom (now appearing as the top) of the bottle structure is pressed down on.

This arrangement of the dispensing bottle 14 within the docking station 12 is referred to as being "inverted" because the first end 26 of the bottle 14 from which the product stored therein is dispensed through outlet port 28 and is positioned downward from a second end 32 of the bottle 14 that forms a substantially flat surface upon which dispensing bottles of this sort are traditionally rested for storage and the like.

The dispensing bottle 14 includes a housing 34 that extends from a first end 36 proximate to which is formed the outlet port 28 to second end 38 that forms the second end 32 of the dispensing bottle 14. Arranged at the second end 38 of the housing 34 is a bottom cap 40. Arranged within the housing 34 is a piston 41 that, as is well known in the art, is designed to move from the second end 38 to the first end 36 as product is dispensed.

Coupled to the first end 36 of the housing 34 through a one way check valve 42 is a bellows 44. The bellows 44 forms a passage 46 extending from the one-way check valve 42 to a second one way check valve 48 arranged proximate to the first end 26 of the dispensing bottle 14. In this regard, the combination of the first check valve 42, the passage 46 formed in the bellows 44, and the second one way check valve 48 forms an evacuation passage extending from a hollow inner portion 50 of the housing 34 to a passage 52 leading to the outlet port 28.

Figure 3:
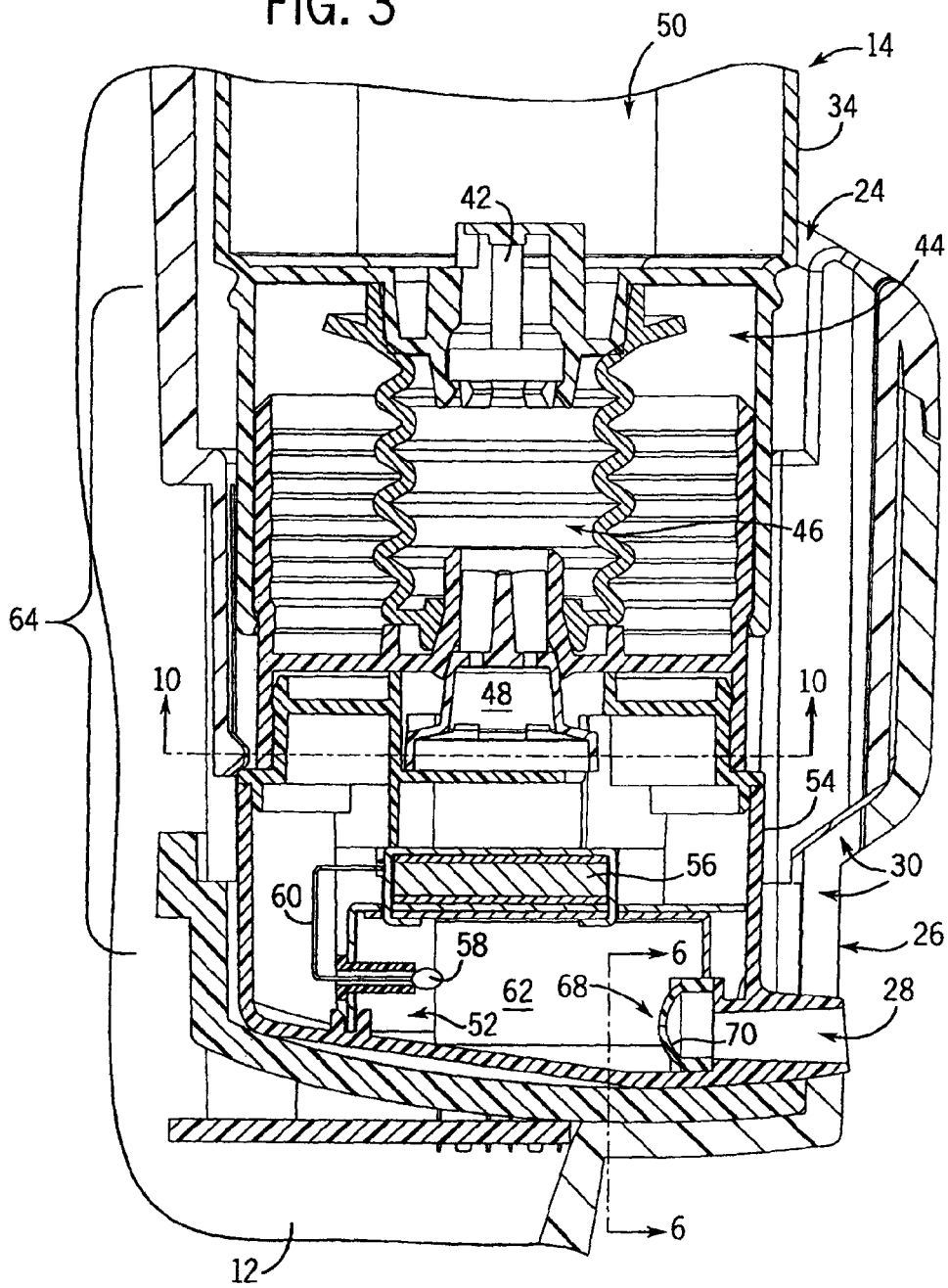
FIG. 3 is an enlarged vertical cross-sectional view focusing on the pumping mechanism and heater region of the FIG. 1 dispensing bottle.

Referring next to FIG. 3, an enlarged view of the first end 26 of the dispensing bottle 14 shows a conglomeration of components collectively comprising an adaptor head 54 of the dispensing bottle 14. Beyond the components previously described with respect to FIGS. 1 and 2, the adaptor head 54 of the dispensing bottle 14 also includes a heating element 56 and a temperature sensor 58 each coupled to the device through leads and contacts. Note for example leads 60. As will be described with respect to FIGS. 11 and 12, the heating element 56 is designed to receive power from the docking station 12 when the dispensing bottle is engaged with the docking station in the inverted configuration shown in FIGS. 1 and 2. Accordingly, the heating element 56 is configured to transfer heat to a baffling 62 or heat sink/heat exchanger extending into the passage 52 leading to the outlet port 28 to heat the product as it moves towards the outlet port 28.

To drive the product from the portion 50 formed at the interior of the housing 34, a pumping system 64 is formed in the adaptor head 54 of the dispensing bottle 14. The pumping system 64 generally includes the check valves 42, 48 and the bellows 44 that work in concert with the remaining element of the pumping system 64, the piston 41 of FIG. 2.

Referring now more generally to FIGS. 2 through 5, when the dispensing bottle 14 is engaged with the docking station 12, second end 32 of the bottle 14 is positioned upward. Accordingly, the housing 34 and bottom cap 40 present a surface designed to be depressed by a user. Upon pressing upon the housing 34 and/or bottom cap 40, the adaptor head 54 is driven into the docking station 12 until the bellows 44 flexes and contracts into a compressed configuration shown in FIG. 4. Accordingly, the product filling the passage 46 extending through the bellows 44 is subjected to an increase in pressure.

Since the first check valve 42 is designed to only allow the product to flow from the portion 50 formed by the housing 34 into the passage 46 formed by the bellows 44 (and not vice versa), the product is forced toward the second one-way check valve 48. The second one-way check valve 48 is designed to permit the product to flow into the passage 52, past the baffling 62, where it is heated, and then out through the outlet port 28. Accordingly, by pressing down upon the second end 38 of the housing 34 and/or the bottom cap 40, a portion of the product stored within the housing 34 can easily be ejected from the outlet port 28 while the dispensing bottle 14 is engaged with the docking station 12.

Following a contraction of the pumping system 64 to dispensing a portion of the product, the bellows 44 is biased so as to return to an expanded state, as shown in FIG. 2. In this regard, a pressure drop is created within the passage 46 through the bellows 44. Accordingly, a portion of the product stored within the portion 50 formed by the housing 34 is drawn through the first check valve 42 to compensate for the pressure drop formed in the passage 46 through the bellows 44.

When a portion of the product stored within the portion 50 formed by the housing 34 is drawn through the first check valve 42 to compensate for the pressure drop formed in the passage 46 through the bellows 44, a corresponding pressure drop is created in the portion 50. Responsive thereto, the piston 41 is drawn down toward the first check valve 42 and air is pulled through the bottom cap 40 via a hole 66 formed therein to fill the void caused by the movement of the piston 41.

While the above-described pumping system is designed to advantageously operate when the dispenser bottle 14 is inverted and arranged in the docking station 12, the pumping system also works if the bottle is removed from the docking station. Hence, it can be brought into a shower or the like while sufficient heat remains in the heating unit to permit continued dispensing of heated product for some time.

Figure 6:
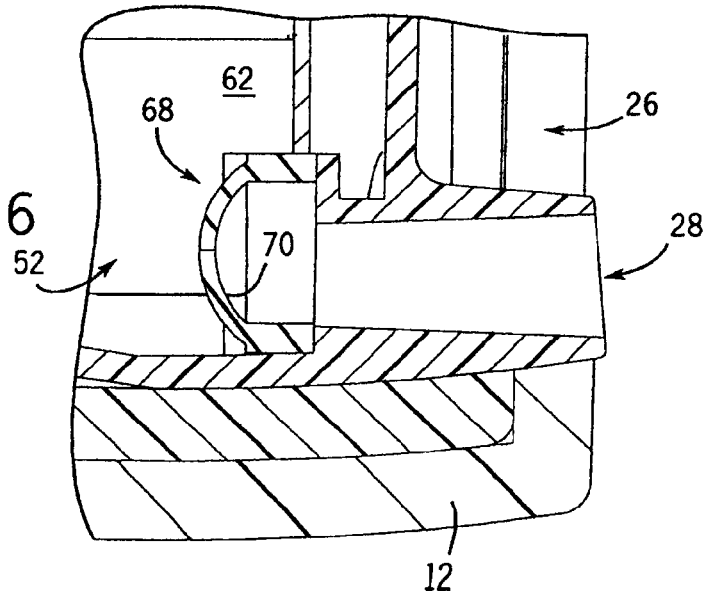
FIG. 6 is a further enlarged vertical cross-sectional view of an outlet port region of the bottle.
Figure 4:
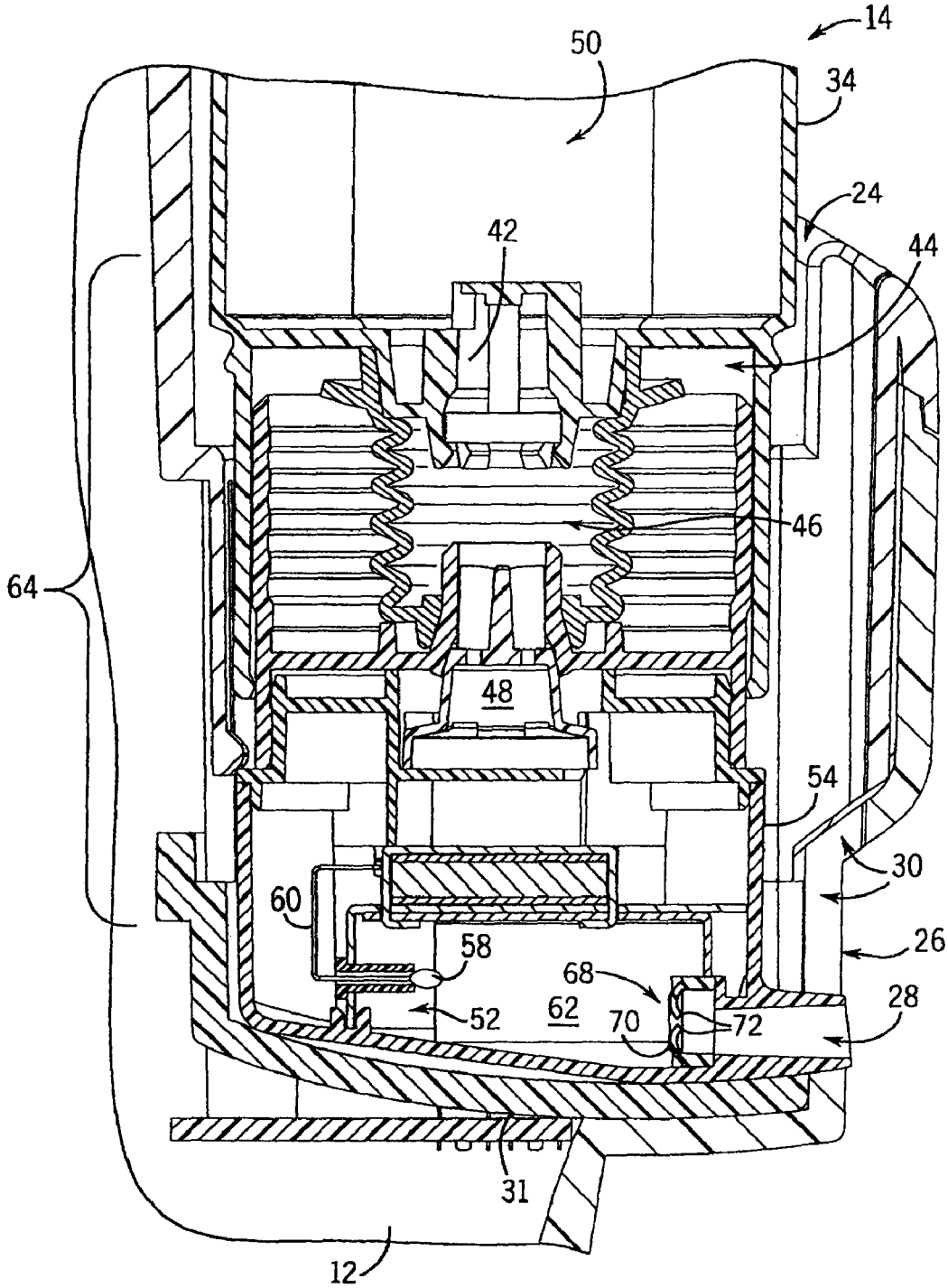
FIG. 4 is a view similar to FIG. 3 but showing the parts after the bottle has been axially compressed.
Figure 5:
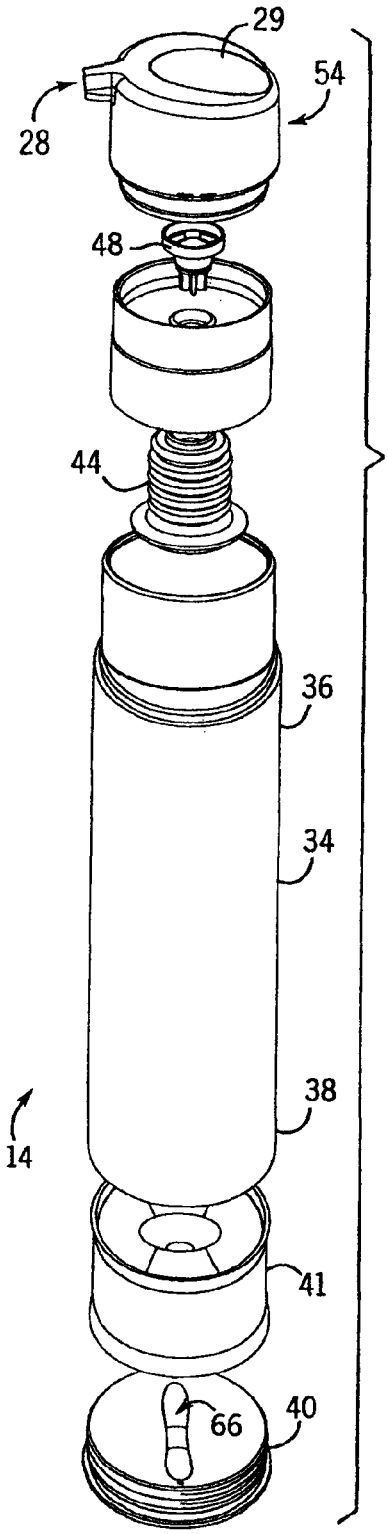
FIG. 5 is an exploded upright perspective view of the dispensing bottle of FIG. 1.

The dispensing bottle 14 also includes an anti-drool system that is configured to substantially reduce the amount of product that is permitted to leak from the outlet port 28 after the bellows 44 has reached the expanded position shown in FIG. 3 following a compression, such as is shown in FIG. 4. First, a valve 68 is arranged over the outlet port 28 to form a barrier between the passage 52 enclosing the baffling 62 and the outlet port 28. Referring to FIG. 6, the valve 68 is in the form of a convex disk 70 that is bulged into the passage 52 behind the outlet port 28.

Figure 19:
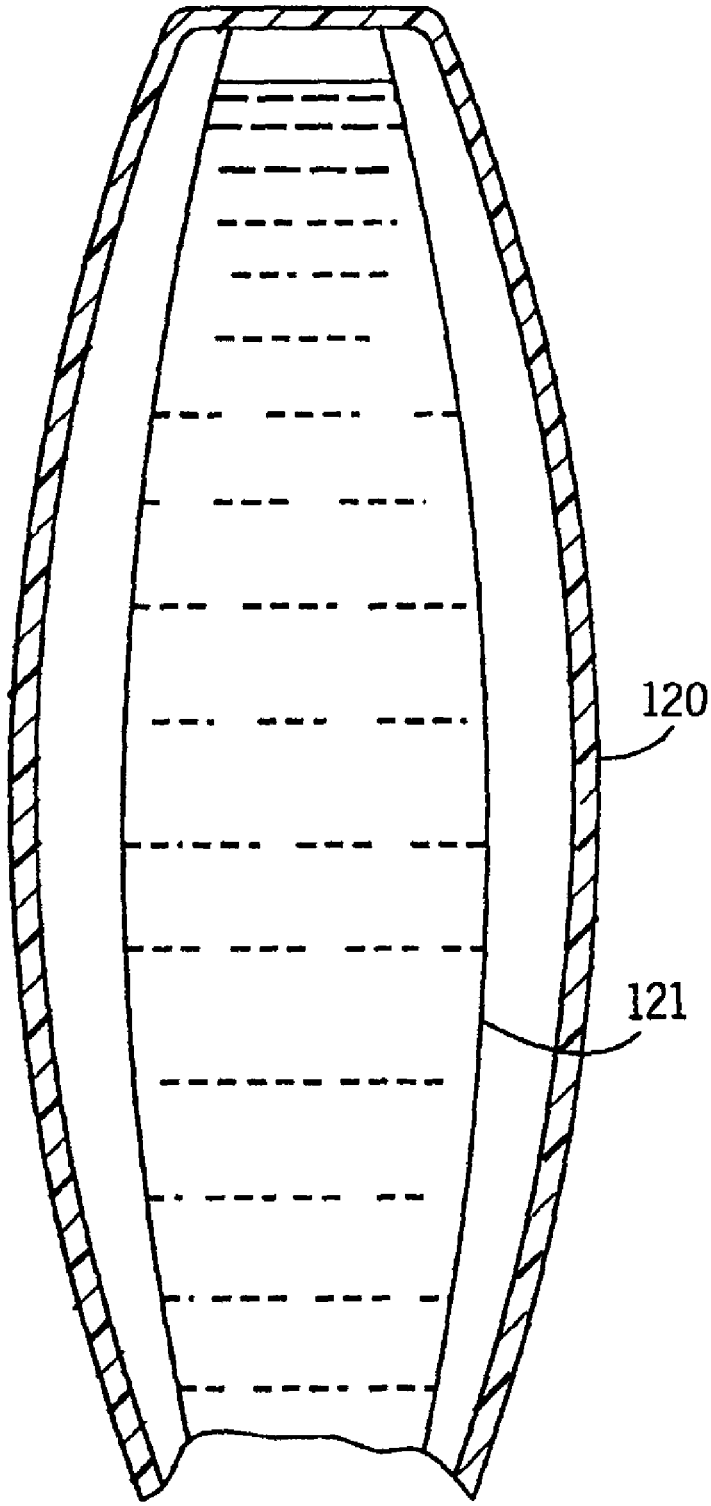
FIG. 19 is a vertical sectional view of a portion of an alternative container.

While a bellows type pumping arrangement has been shown thus far, it should be appreciated that the bellows feature could be removed from the FIG. 2 embodiment and instead the attachment point could be linked to a collapsible bag type structure as shown in FIG. 19 where a bottle has flexible outer squeeze walls 120 and an internal collapsible bag 121. Squeezing the walls 120 would drive product out of the bag 121 into the inlet of check valve 42 and thus through the heating device.

Alternatively the FIG. 2 embodiment could be altered by attaching the check valve 42 to a collapsible bag type structure as shown in FIG. 19 where a bottle has outer walls 120 and an internal collapsible bag 121. Pumping would drive product out of the bag 121 into the inlet of check valve 42 and thus through the heating device.

Still another alternative would be to use a Graham-type bag in a bottle structure, e.g. where the bag is blow molded along with the walls of the bottle. One could then attach the upper portion of the bag to a more traditional type push down pump, and then connect near the pump a heater such as one depicted in the drawings herewith or in a structure like U.S. Pat. No. 6,454,127, the latter being incorporated by reference as if fully set forth herein.

When using a bag in a bottle type construction, venting may be achieved by placing a hole in the outer wall of the bottle that feeds air outside of the bag as the bag collapses. If desired, that hole could be controlled by a valve, such as the one in U.S. Pat. No. 5,699,921, where a duckbill vent valve extends through a wall of a container to equalize pressure as a bag collapses. Alternatively a variety of other types of vent valves could let air in through a side or bottom wall of the bottle as the bag collapses (e.g. umbrella valves).

Figure 27:
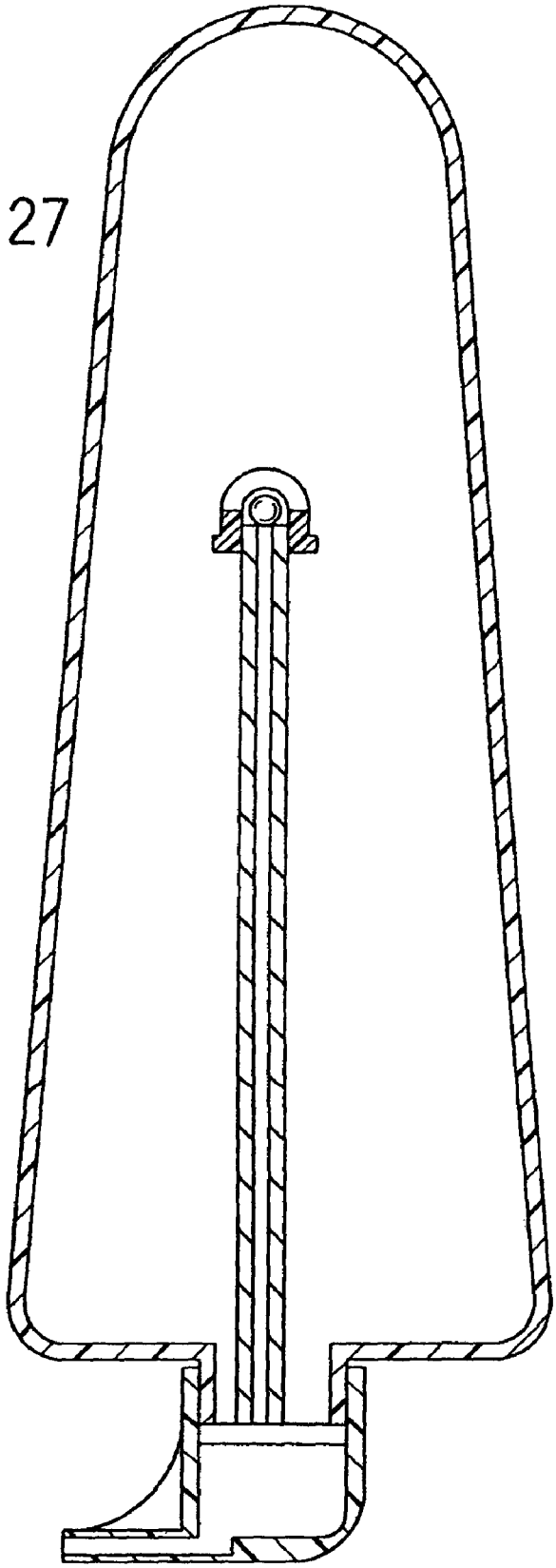
FIG. 27 shows another embodiment of an air vent system.

One can alternatively use a down tube for a vent path as taught in U.S. Pat. No. 6,394,315, where passage through the vent tube can be controlled by a variety of flap, ball, or other types of one-way valves. See e.g. FIG. 27 of our invention showing a caged ball valve at a lower end of a dip tube. When the container is inverted a ball rests on a closure seat stopping lotion from exiting through that tube (as distinguished from through a heater/adapter path). When the container is right side up, the ball falls away from the tube, allowing air to vent.

A variety of collapsible bag bottles are sold in the market, albeit without the heater function. See for example those of Owens-Brockway in U.S. Pat. Nos. 6,083,450, 6,238,201 and 6,719,173, these patents being incorporated by reference as if fully set forth herein. Other manufacturers of collapsible bag bottles include Graham and MegaPlast.

Figure 7:
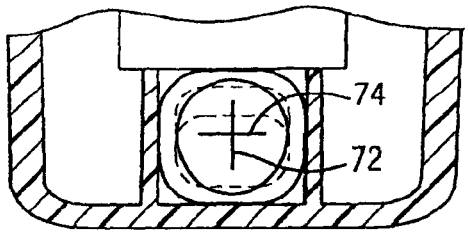
FIG. 7 is an enlarged transverse sectional view of that outlet port region.

Referring next to FIG. 7, the disk 70 includes two cross slits 72, 74 that extend perpendicular to each other across the disk 70. Accordingly, as shown in FIGS. 2, 3, and 6, when the bellows 44 is in the expanded position, the disk is bulged into the passage 52 behind the outlet port 28 and the slits 72, 74 are held closed by the natural convex shape of the valve 68. However, when the pressure within the passage 52 is sufficiently increased during pumping of the dispensing bottle 14, the pressure increase overcomes the natural desire of the valve 68 to remain bulged into the passage 52 and, as shown in FIG. 4, the slits 72, 74 allow the disk 70 to break to form a passage through the valve 68 and into the outlet port 28.

The valve 68 will remain in this position until the pressure within the passage 52 drops sufficiently to allow the disk 70 to return to its convex shape, thus, closing the slits 72, 74. In this regard, once the pumping process discontinues and the pressure within the passage 52 drops, the valve 68 serves to restrict any additional product from entering the outlet port 28. Thus, additional product is precluded from becoming drool from the outlet port 28.

Figure 8:
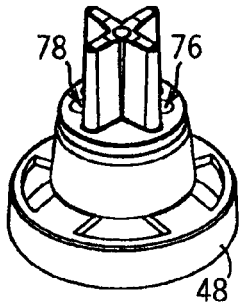
FIG. 8 is a perspective view of a check valve positioned immediately downstream of the pumping bellows of the FIG. 1 embodiment.
Figure 9:
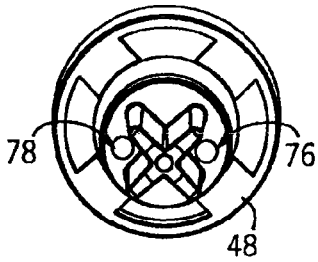
FIG. 9 is another perspective view of that check valve.
Figure 10:
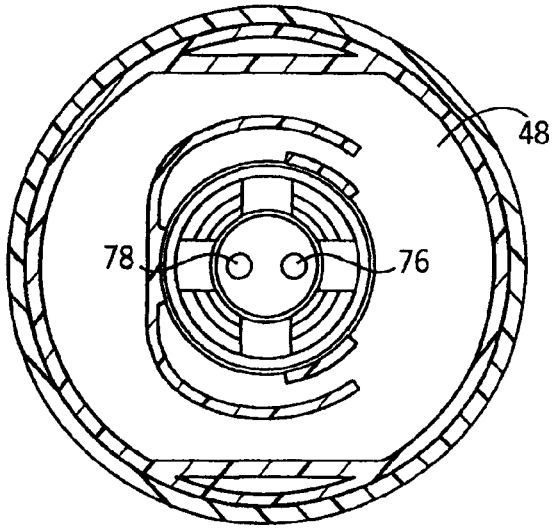
FIG. 10 is a plan view of the FIG. 9 check valve.

Referring now to FIGS. 8 through 10, to expedite the closing of the valve 68 after full compression of the bellows 44 has been reached and the pressure in the passage 52 is no longer increasing, it is contemplated that the second one-way check valve 48 may include one or more bleed passages 76, 78. In this regard, the bleed passage 76, 78 serve to expedite the drop in pressure experienced in the passage 52 formed behind the outlet port 28 so that the valve 68 can close more quickly than would otherwise naturally happen. In particular, the bleed passages 76, 78 permit a quantity of the product disposed within the passage 52 to "bleed" or "leak" back into the passage 46 within the bellows 44, which would otherwise be precluded by the second one way check valve 48. By forming the bleed passage 76, 78 around the second one-way check valve 48, the resulting artificial pressure drop created in the passage 52 allows the leak valve 68 to close and stop any additional product from entering the outlet port 28 and contributing to drool.

Figure 11:
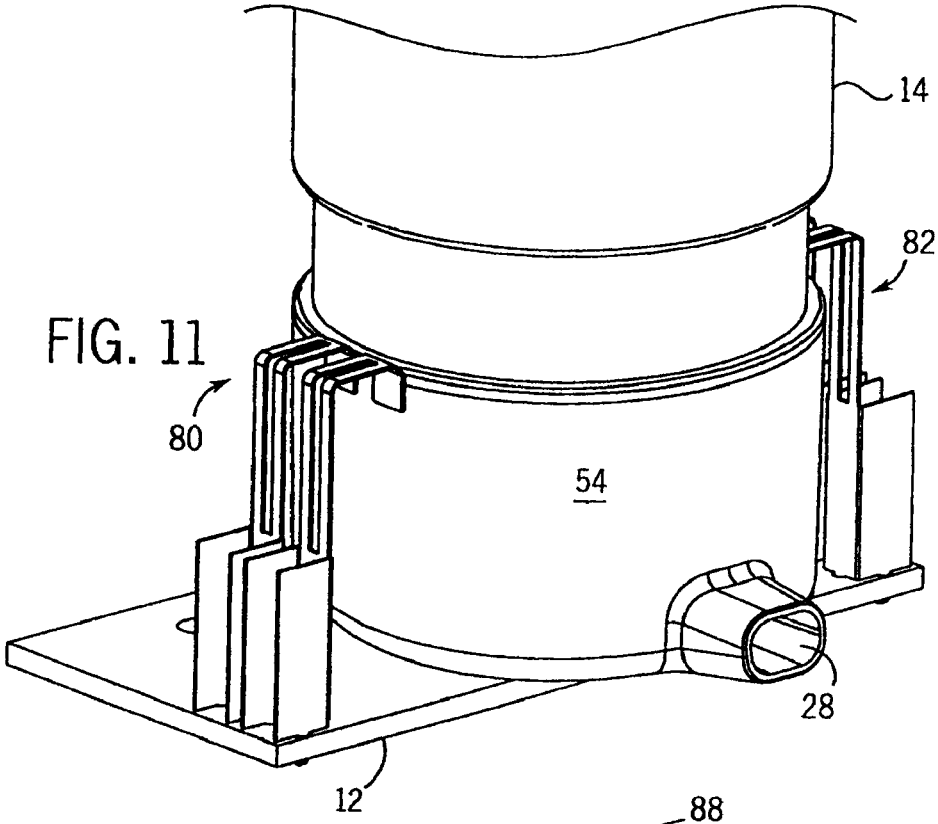
FIG. 11 is a perspective view of the head of the FIG. 1 dispensing bottle, showing the bottle inverted and engageable with a sensor system included in a nearby docking station.
Figure 12:
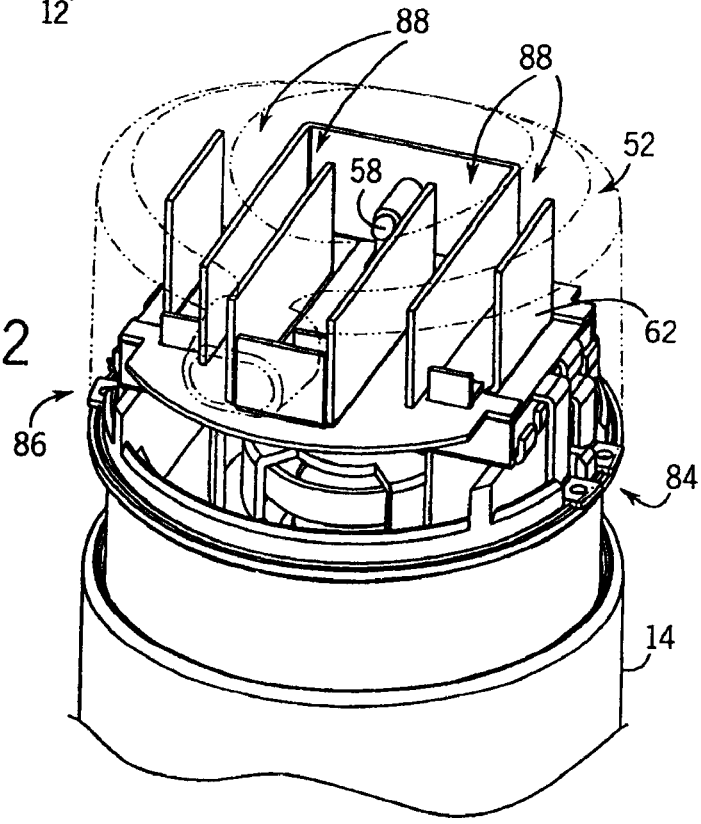
FIG. 12 is a perspective view, partially disassembled, of a heater region of the present device, with focus on heat conductive baffling.

Referring now to FIGS. 3, 11, and 12, the heating element 56 is configured to receive power when the dispensing bottle 14 is engaged with the docking station 12 in an inverted arrangement. Accordingly, the adaptor head 54 is configured to engage opposing sets of fingers 80, 82 that extend from the docking station 12. The fingers 80, 82 extend to engage corresponding contacts 84, 86 formed along the periphery of the adaptor head 54.

When the dispensing bottle 14 is arranged in the docking station 12, the contacts 84, 86 meet with the fingers to complete an electrical connection that allows for power to flow from the docking station 12 to the dispensing bottle 14. In turn, the power is provided to the heating element 56, for example, a resistive heating element, that is energized to produce heat. As previously stated, a baffling 62 forms a tortured path 88 through the passage 52 leading to the outlet port 28. Accordingly, as the product is moved toward the outlet port 28, it is exposed to the baffling 62 and heated.

To protect against overheating that could negatively impact the desirability of the product, the temperature sensor 58 is arranged along a central portion of the passage 52 leading to the outlet port 28. In this regard, the temperature sensor 58 provides an indication of the approximate temperature of the product prior to being forced from the outlet port 28 and consumed by a user. The heating element 56 is designed to receive this temperature feedback from the temperature sensor 58 to determine whether the product currently located in the passage 52 leading to the outlet port 28 has been sufficiently heated.

If the feedback from the temperature sensor 58 indicates that the product has reached a desired temperature, the heating element 56 turns off. Thereafter, should the temperature of the product drop below a predetermined threshold, such as when the dispensing bottle 14 is pumped and the heated product is replaced by a new quantity of product or when the product simply cools below the given threshold, the heating element 56 turns back on to deliver heat to the product through the baffling 62.

Other electrical controls may also be provided. For example, while we do not use a timer to shut off the device after a fixed period once activation has occurred, the control circuitry could instead be designed to automatically shut off after a certain amount of power is used, or after a specific number of temperature variation cycles, absent further initiation by the consumer, to avoid keeping the device on perpetually if the consumer forgets to turn it off.

Figure 20:
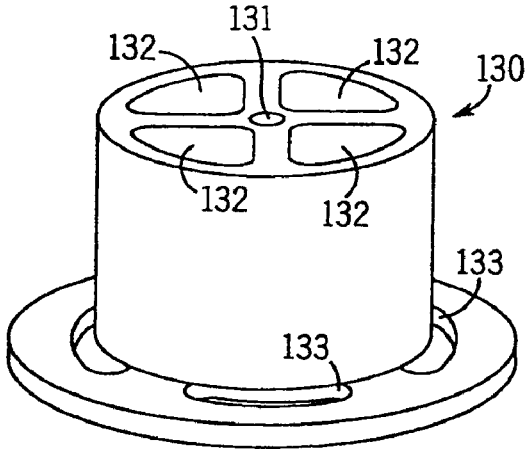
FIG. 20 is an enlarged perspective view of an alternative heater element.

Of course, the adapter may take other configurations. For example, in FIG. 20 we show an adapter housing 130 in which there is a venting passage 131 which can bleed air back into the bottle. If desired, the bottom of the venting/bleed passage 131 can be a flap valve or other check valve so as to prevent product flow through that passageway. The passageways 132 carry the product, and electrical coupling points 133 can cause the overall housing 130 to heat up.

Figure 21:
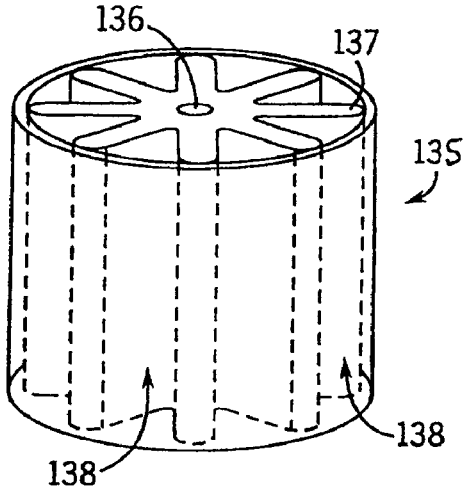
FIG. 21 is an enlarged perspective view of a second alternative heater element.

FIG. 21 shows another alternative adapter housing 135. Here the vent passageway 136 is analogous to venting passage 131. However, the metal of the housing 135 is floral in shape and the product passes between the arms of the flower arms such as along pathways 138. Again, this structure would provide venting through the adapter.

Figure 22:
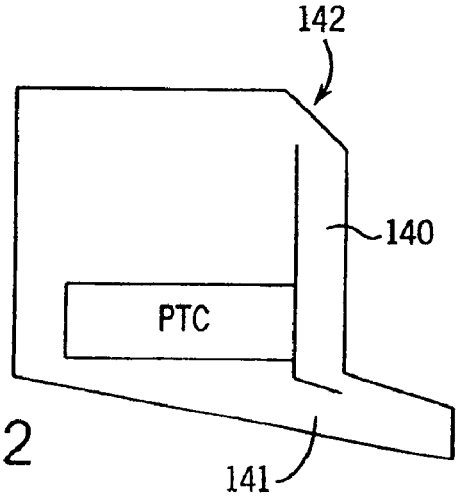
FIG. 22 is a schematic sectional view of an alternative adapter having a venting feature incorporated into the adapter.

FIG. 22 shows still another way to vent. In this device product will normally flow past flap 141. However, when product is not being pumped out, that flap closes off the PTC area opening up a vent pathway 140. Second flap 142 prevents product from entering the vent pathway 140 but will spring open in the absence of product pressure.

Figure 13:
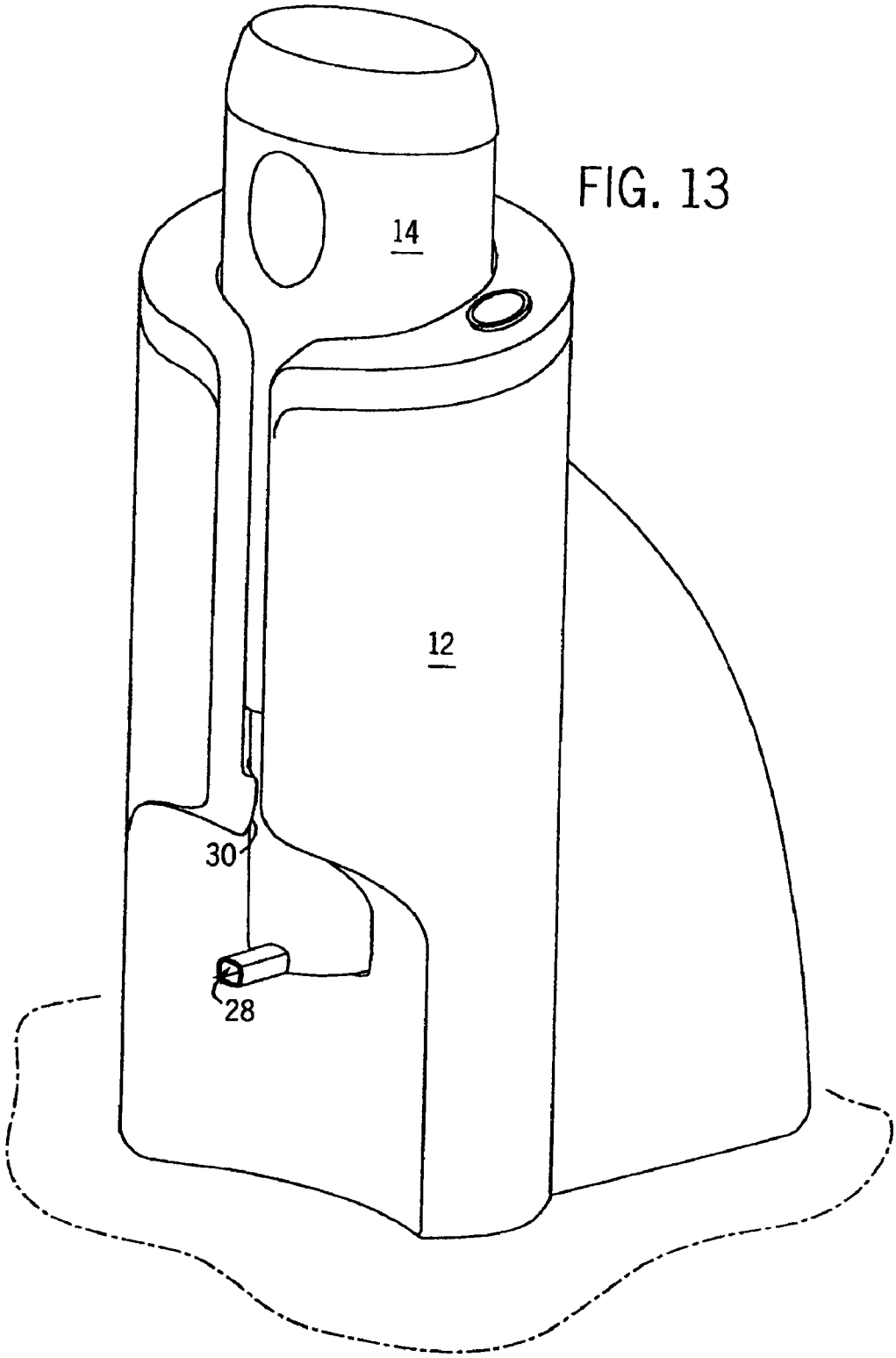
FIG. 13 is a perspective view of a second embodiment where the bottle and base are of a somewhat different configuration.

Referring next to FIG. 13, it is contemplated that the docking station 12 and dispensing bottle 14 may take varied forms. For example, the portal 30 may be extended to form a slot through which the outlet port 28 can more easily pass as the dispensing bottle 14 is positioned in the docking station 12. This arrangement allows for additional changes, such as increasing the height of the docking station 12 to accommodate larger dispensing bottles 14 or extending the length of the outlet port 28.

Figure 14:
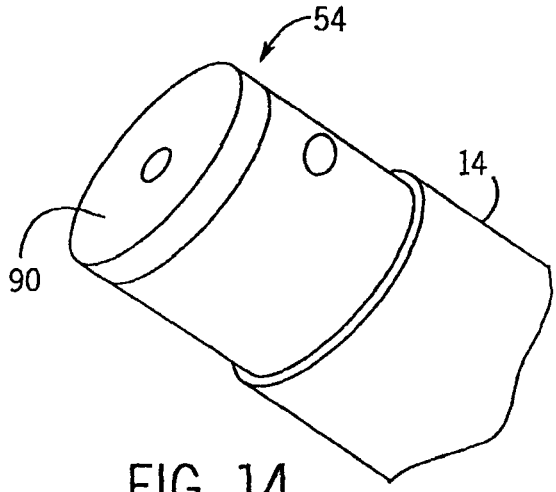
FIG. 14 is a perspective view of an applicator engaged with an alternative dispensing bottle.
Figure 15:
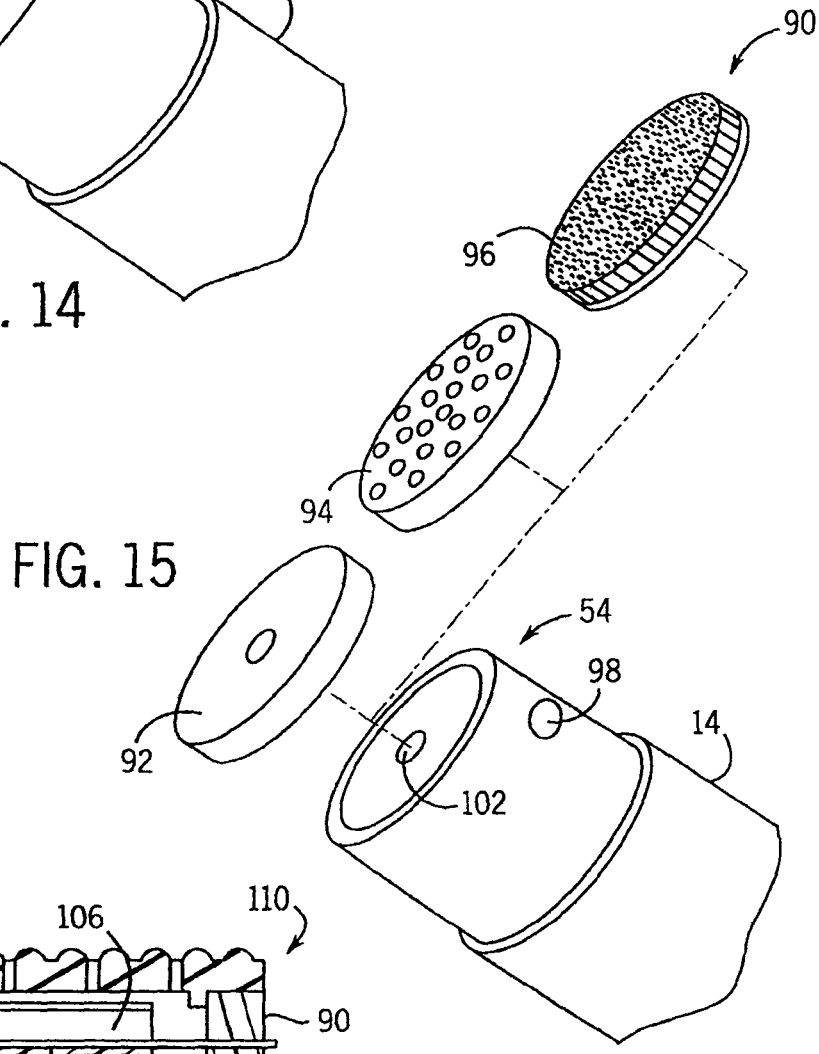
FIG. 15 is a partially exploded view of the FIG. 14 structures, showing also a plurality of alternative interchangeable and replaceable applicators.
Figure 16:
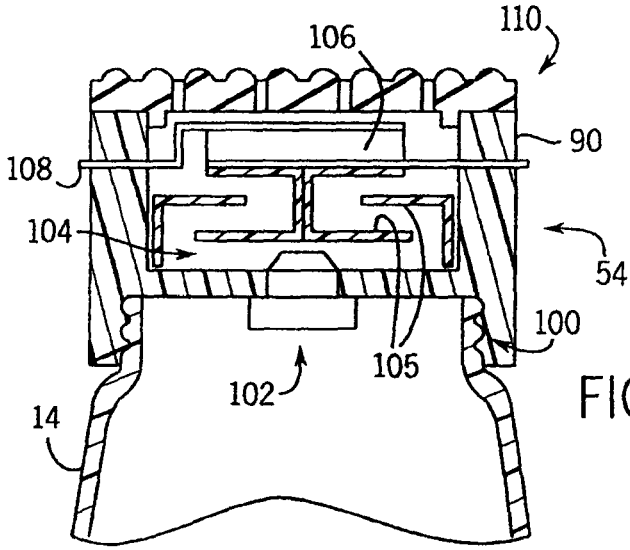
FIG. 16 is a vertical cross-sectional view of the FIG. 14 device when assembled with an alternative applicator of FIG. 15.

Referring now to FIGS. 14 through 16, it is contemplated that the adaptor head 54 of the dispensing bottle 14 may be adapted to receive an applicator 90. The applicator 90 may take any of a variety of forms, such as a sponge 92, a porous applicator 94, a brush 96, or any other suitable arrangement. Accordingly, it is contemplated that applicators 90 may be removable and interchangeable. In particular, the dispensing bottle 14 may include one or more release buttons 98 that allow the various applicators 92, 94, 96 to be selectively engaged and disengaged with the dispensing bottle 14. Alternatively, referring to FIG. 16, it is contemplated that the applicator 90 may engage the dispensing bottle 14 through a threaded engagement 100.

In any case, the applicator 90 is configured to engage a valve 102 forming a passage from the dispensing bottle 14 through which to receive the product. Optionally the valve 102 could be removed. Once the product has passed through the valve 102 (or adjacent pathway if there is no valve 102), it enters the applicator 90. It is contemplated that the applicator 90, like the adaptor head 54 described above, may include a tortured path 104 formed by baffling 105 that is heated by a heating element 106 powered by way of a contact designed to engage a corresponding contact in a docking station. In a manner similar to that described above, when the heating element 106 is powered, the baffling 105 is heated. If desired, the mass of the walls of the path can be thickened to provide an even greater heat source, with a material such as textured aluminum providing the walls of the path.

However, according to this configuration, the heating element 106 is also configured to heat an applicator surface 110 of the applicator 90. Accordingly, this arrangement significantly improves over traditional heating systems that include applicators that typically fail to heat the actual applicator surface 110 and, as such, often defeat the purpose of heating the product because the user is subjected the discomfort of a cool applicator surface 110.

Another alternative is that the applicator feature could be integrally formed with the cap. This might render heat transfer even more efficient, albeit it might complicate modification of the applicator surface.

Ways to further enhance heat efficiency and retention include incorporating high heat conductive materials such as graphite or aluminum. Also, heat storage can be prolonged by incorporation phase change materials into the system.

Regardless of the nature of the adaptor it is desirable that the pathway through the adaptor for the product to be long enough for the product to heat up to a desired temperature before exiting. Further, especially prolonged pathways may permit the canister to be used remotely from the base for especially prolonged periods. Hence, particularly serpentine, tortuous, or spiral pathways may be desirable through the adaptor to optimize thermal storage.

Note that in replacement for a single serpentine pathway through the heater, a solid heater block can be used which has multiple through pathways aligned with the multiple apertures of the surface 110. This may have certain advantages in avoiding venting issues, depending on the nature of the product.

Figure 17:
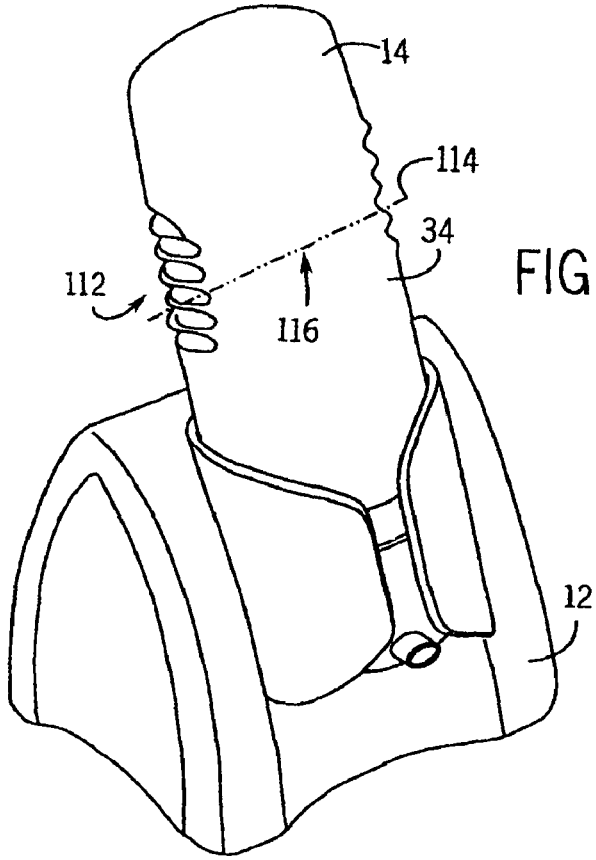
FIG. 17 is a perspective view of another alternative embodiment.
Figure 18:
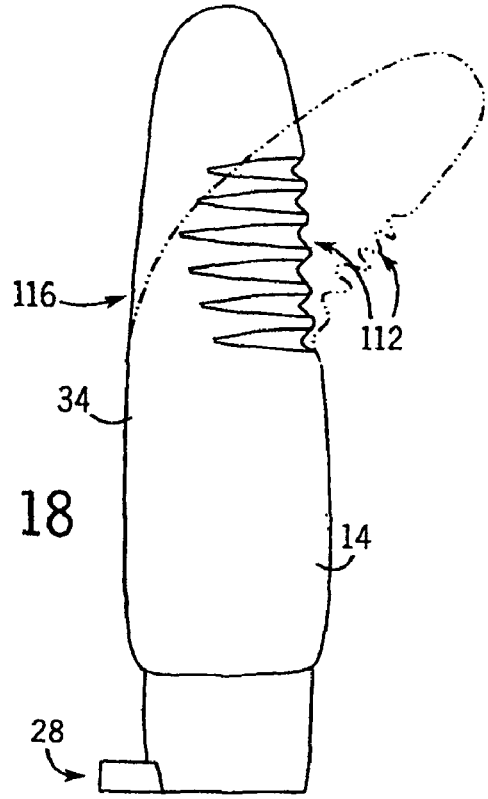
FIG. 18 is a side-elevational view of the bottle of FIG. 17.

It is also contemplated that various other systems may be utilized to drive the product from the dispensing bottle 14. For example, referring to FIGS. 17 and 18, the dispensing bottle 14 may include a flexible bellows 112 that extends transversely around only a portion of the semi-rigid housing 116 forming the bottle 14 to form a pivot axis 114 across the dispensing bottle 14. Accordingly, to dispense the product from the dispensing bottle 14, a user presses against the dispensing bottle 14 causing the bellows 112 to flex and the opposingly oriented semi-rigid housing 116 bend along the pivot axis 114 to contract the overall area of the dispensing bottle 14 and force a portion of the product from the outlet port 28. This is referred to as a bowing pump. With such a device the product could alternatively be arranged in a compressible bag (like that of FIG. 19) that collapses as the product is dispensed from the dispensing bottle 14. Note that if the bellows are instead extended entirely around the circumference of the bottle, a completely axially directed compression can be used rather than a "bowing" compression which has multiple aspects.

FIGS. 23-26 depict the use of an automated flip cap that helps reduce drool issues between uses. This embodiment discloses a bottle 200 with an adaptor 201, and a flip cap 202 pivotable on a horizontal axis 203. This is particularly useful with a bottle that can both be axially compressed and squeezed along the sides.

When the bottle 200 is in the docking station 206 part of the flip cap 202 rests on a ledge 207 of the station. However, a spring 208 forces the cap 202 such that the cap's outlet 210 is closed off by part of the adaptor 212. When, as shown in FIG. 25, a consumer presses down on the bottle, the cap end 205 is forced by ledge 207 to overcome the spring pressure, thereby permitting outflow. When the bottle is removed from the docking station and manual pressure is applied with a finger as shown by arrow 220, while the bottle is being squeezed on its sides, dispensing can occur.

There can be a bead 225 on the flip cap 202 which can snap past a ridge 226 on the adaptor. This position can be reached via sufficient manual pressure so that the cap doesn't have to be held open through manual use. However, the docking station and adaptor are configured to prevent axial movement to that extent. Thus, the cap can be locked open during manual use in this form, but not while in the base.

A variety of additional changes can be made to these devices without departing from the spirit of the invention or the scope of the claims. For example, depression 29 (see FIG. 5) can be placed in the upper adapter structure which optionally has a complementary configuration to a raised bump (not shown) near number 31 in FIG. 4. A cap not having this depression would be held up too high in the docking station for the bottle contents to be heated. Hence, this could provide an additional safety control over the types of canisters inserted in the device.

Moreover, where bellows are around the exterior of the bottle they may be formed far enough away from the bottle ends that the bottle can either be axially compressed or have its ends squeezed (e.g. near bottle numeral 14 in FIG. 17) depending on consumer preference.

Further, other features can be incorporated with this product such as a clock timer that starts the heating system automatically at a particular time (e.g. morning), or multiple receiving cavities so as to warm multiple products at the same time (e.g. cosmetic lotion and shaving lotion).

Thus, the claims, when presented, should not be construed as being limited to just the disclosed preferred embodiments.

INDUSTRIAL APPLICABILITY

The present invention provides devices for delivering heated products (such as personal care products or heated cleaners), and bottles useful therewith.

What is claimed is:

1. A device for dispensing a heated flowable product, comprising:

a docking station connectible to an electrical power source; and a bottle having a flowable product stored therein and configured to be removably engaged with the docking station so as to be activated by the docking station and heat a portion of the flowable product, the bottle comprising:

a housing with a flexible side, the housing having an internal main reservoir storing the flowable product;

a heating element which is capable of heating a portion of the flowable product once it is driven from the reservoir, the heating element being configured to be activatable by the docking station; and an outlet arranged downstream of the heating element and suitable to receive heated flowable product;

wherein the flexible side can be positioned at least somewhat outside of the docking station when the bottle is mounted in the docking station with the heating element activated, so that upon squeezing the flexible side of the housing the flowable product can then be driven out the outlet.

2. The bottle of claim 1, wherein the flexible side has a bellows configuration which permits the housing to be axially compressed, as well as squeezed along its side below the bellows configuration.

3. The device of claim 1, wherein the bottle further comprises a cap downstream of the heating element through which the outlet extends, the cap having a surface suitable to contact human skin.

4. The device of claim 3, wherein the cap is capable of being heated by the heating element.

5. The device of claim 3, wherein the cap has a textured outer surface suitable for working the flowable product against human skin.

6. A bottle having a flowable product stored therein and configured to be removably engaged with a docking station so as to be activated by the docking station and heat a portion of the flowable product, the bottle comprising:

a housing with a flexible side, the housing having an internal main reservoir storing the flowable product;

a heating element which is capable of heating a portion of the flowable product once it is driven from the reservoir, the heating element being configured to be activatable by the docking station; and an outlet arranged downstream of the heating element and suitable to receive heated flowable product;

wherein upon squeezing the flexible side of the housing the flowable product can be driven out the outlet;

wherein the bottle further comprises a cap downstream of the heating element through which the outlet extends, the cap having a surface suitable to contact human skin;

wherein the cap has an outer surface which is a brush and/or a sponge surface.

7. A device for dispensing a heated flowable product, comprising:

a docking station connectible to an electrical power source; and a bottle having a flowable product stored therein and configured to be removably engaged with a docking station so as to be activated by the docking station and heat a portion of the flowable product, the bottle comprising:

a flexible housing, the housing having an internal cavity;

a collapsible bag positioned in the cavity for storing the flowable product;

a heating element which is capable of heating a portion of the flowable product once it is driven from the bag, the heating element being configured to be activatable by the docking station; and an outlet arranged downstream of the heating element and suitable to receive heated flowable product;

wherein the flexible housing can be positioned at least somewhat outside of the docking station when the bottle is mounted in the docking station with the heating element activated, so that upon squeezing the flexible housing the flowable product can then be driven out the outlet.

8. A bottle having a flowable product stored therein and configured to be removably engaged with a docking station so as to be activated by the docking station and heat a portion of the flowable product, the bottle comprising:

a housing having an internal main reservoir storing the flowable product;

a heating element positioned proximate to the reservoir which is capable of heating a portion of the flowable product once it is driven from the reservoir;

a flip cap arranged downstream of the heating element for pivotable movement between a first position permitting heated flowable product to pass there through, and a second position closing off flow of the heated flowable product through the flip cap; and a biasing member for biasing the cap towards the second position;

wherein sufficient movement of the flip cap against spring pressure can cause the flip cap to lock into a third position permitting heated flowable product to pass there through even without a need for holding the flip cap in the third position, due to an interaction between a bead on the flip cap and a ridge on an adjacent structure.

9. A device for dispensing a heated flowable product, comprising:

a docking station connectible to an electrical power source;

a bottle:

having a flowable product stored therein and configured to be removably engaged with the docking station so as to be activated by the docking station and heat a portion of the flowable product, the bottle comprising:

a housing having an internal main reservoir storing the flowable product;

a heating element positioned proximate to the reservoir which is capable of heating a portion of the flowable product once it is driven from the reservoir;

a flip cap arranged downstream of the heating element for pivotable movement between a first position permitting heated flowable product to pass there through, and a second position closing off flow of the heated flowable product through the flip cap; and a biasing member for biasing the cap towards the second position;

wherein a projection is provided on the docking station for driving the flip cap from the first position to the second position when the bottle is pushed down relative to the docking station.

* * * * *